United States Patent [19]

Cappé

[11] 4,442,651

[45] Apr. 17, 1984

[54] PROCEDURE AND ARRANGEMENT FOR LAYING THE FOUNDATION OF PREFABRICATED PLANTS ASHORE

[75] Inventor: Carl Cappé, Stockholm, Sweden

[73] Assignee: NYA Asfalt AB, Stockholm, Sweden

[21] Appl. No.: 261,234

[22] PCT Filed: Jan. 24, 1980

[86] PCT No.: PCT/SE80/00022

§ 371 Date: Oct. 3, 1980

§ 102(e) Date: Oct. 3, 1980

[87] PCT Pub. No.: WO80/01581

PCT Pub. Date: Aug. 7, 1980

[30] Foreign Application Priority Data

Feb. 5, 1979 [SE] Sweden ..... 7900955

[51] Int. Cl.[3] ..... E04G 21/00

[52] U.S. Cl. ..... 52/745

[58] Field of Search ..... 52/745; 14/13

[56] References Cited

U.S. PATENT DOCUMENTS 4,283,890 8/1981 Takeda et al. ..... 52/745

OTHER PUBLICATIONS

Sterling Homex Corporation Annual Report for 1970, p. 13.

War Department Technical Manual issued Sep. 15, 1943.

*Primary Examiner*—James L. Ridgill, Jr.

*Attorney, Agent, or Firm*—Cushman, Darby & Cushman

[57] ABSTRACT

The invention refers to a procedure for laying the foundation of prefabricated plants (7) comprising such types as processing plants, industrial buildings, hospitals, hotels, etc., and for their removal, assembly and foundation building at the place of destination (10) ashore.

Foundations (4) are made ashore or in a dry dock or on a barge, after which the processing plant is assembled. If the foundation is manufactured outside the barge (1), the plant (7) and/or foundation (4) can be moved to transport barges (1). Transport to the place of destination is carried out by means of sea-going transport barges (1). At the place of destination (9) the transport barges (1) are lowered onto an erection bed (2), and the plant (7) is launched over prefabricated sliding supports (5) from transport barge to the definitive erection site (10), which can advantageously be situated above the water level in the vicinity of the beach (9) or ashore.

2 Claims, 3 Drawing Figures

PROCEDURE AND ARRANGEMENT FOR LAYING THE FOUNDATION OF PREFABRICATED PLANTS ASHORE

The present invention refers to plants, building construction and industrial building establishments.

As a result of vacant shipyard capacity, problems of environmental protection etc. and because there is a great need for such types of buildings as processing plants, industrial, hospital and hotel buildings, etc., the development of floating factories with compact processing plants and intensively utilized buildings has been accelerated. Projects intended to satisfy these needs are at present chiefly orientated towards single projects administered via industrial enterprises in industrialized countries.

Known procedures are the manufacturing and towing of complete barge- or ship-based industrial plants, e.g. petrochemical or hospital buildings, etc. in one unit or divided up into several units.

One great problem with such plants is that they cannot be permitted to spread out, to expand, as land-based industrial plants can. It is necessary to build as compactly as possible, and the possibility of extremely trying conditions at sea and on beaches must be taken into account. These conventional, compact, more or less seaworthy plants suffer from unfavourable conditions for operation and maintenance—and they are therefore expensive.

The barges on which the plants are built, and which usually form the future foundations, float on the water but are as a rule not dimensioned for towing at sea. In accordance with known techniques the units, consisting of a foundation in the form of a barge, are therefore loaded together with the plant onto very large transport barges of steel, which are towed by sea-going tugs.

In the neighbourhood of the place of destination, the units are then unloaded and the foundation barges towed in towards the beach, where they are placed separately or adjoining one another on a bed constructed below the water.

The destination area is usually given the form of a basin. After the laying-up bed has been made, the basin is refilled as a rule with earth, and the plant thus functions as a land-based unit, with its foundation below sea-level or water table.

Many of the disadvantages entailed by this known technique can be avoided, and many surprisingly substantial advantages can be achieved, if a procedure and arrangements as described in the invention are used.

When, by means of the present invention, it also becomes possible to move entire sea-transported processing plants, hotels, hospitals, etc. ashore, where there are possibilities of expanding and growing and where risks for damage to sea and ground water are to be avoided, increased interest can be expected in prefabricated sea-transported plants.

The method of procedure described in the invention does as a matter of fact enable use to be made of existing highly sophisticated and specialized production resources, as well as advanced technology and skills even if, and above all, these are not available at or in the neighbourhood of the place where the plant is to be used.

BRIEF SUMMARY OF THE INVENTION

In order to explain the character of the invention, a description is given below of the method or procedure and arrangements as well as of the advantages obtainable by use of the invention. The examples given do not restrict the scope of the patent requirements.

One of the aims of the invention is to do without the above-mentioned foundation barges entirely, and instead to build the plant on a foundation of concrete (non-tensioned reinforced or prestressed), steel or the like, which after any necessary or desirable testing of the plant can be launched or assembled on a large transport barge suitable for towing at sea.

The unit, consisting of foundation and plant, is then unloaded from the transport barge and put ashore at the place of destination.

Naturally, the units consisting of a foundation and tne plant can be built wholly or partly directly on the transport barge, and can thereafter be tested and given a trial run if this is found necessary.

Naturally also, the invention provides for combination of the methods of construction, assembly and testing as described.

The possibility is also available of prefabricating the plant and the prefabricated foundation in dry conditions, for example in a dock, and of floating the foundation onto the sea-going transport barge. In this case the foundation is made floating for the first stage of the transport, although in the definitive placing of the plant the foundation will not be exposed to water pressure or contact with water.

If this method of loading is used for the foundation and the plant on the ocean-going transport barge, launching takes place from the transport barge to the future supports without making use of the foundation's floating power. Combinations of the methods of transport described above are of course possible. Combination with other methods of removal using known techniques is also possible.

It is naturally also possible to assemble the plant by a method of procedure as described in the invention by arranging to have various parts of the plant manufactured by suitable specialists and by having the plants assembled on the site after individual transport from each place of manufacture.

It is of course also possible to combine the method of laying a foundation for the plant as described in the invention with conventional methods of assembly for parts of the project.

BRIEF DESCRIPTION OF THE DRAWINGS

FIG. 1(*a*) is a view similar to that of FIG. 1 except showing the plant and foundation partially moved horizontally onto the towing barge.

DETAILED DESCRIPTION OF THE INVENTION

Figure 1:
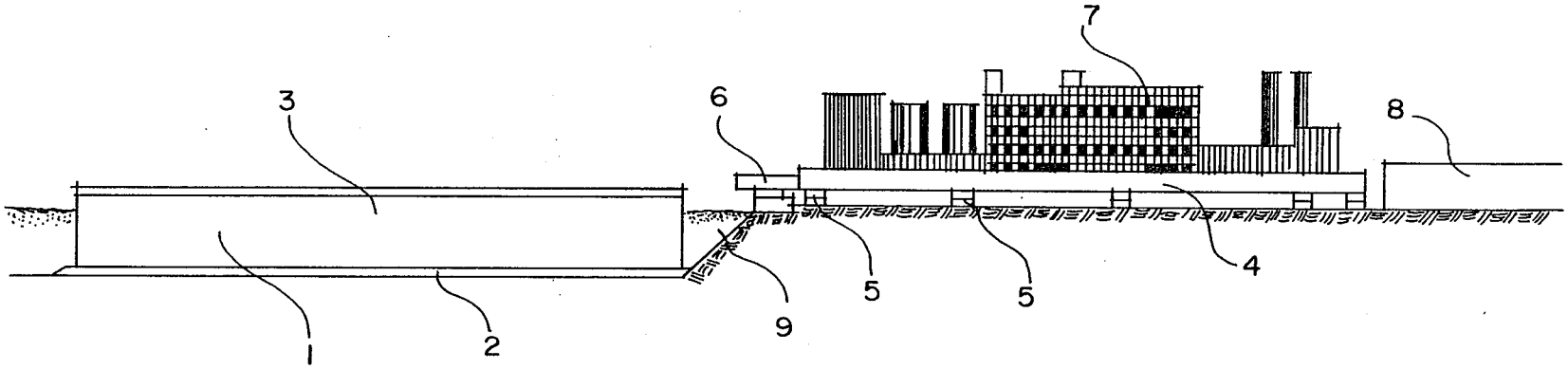
FIG. 1 is a side view in elevation of the constructed plant or other building structure on a foundation and a towing barge located in the water.
Figure 1A:
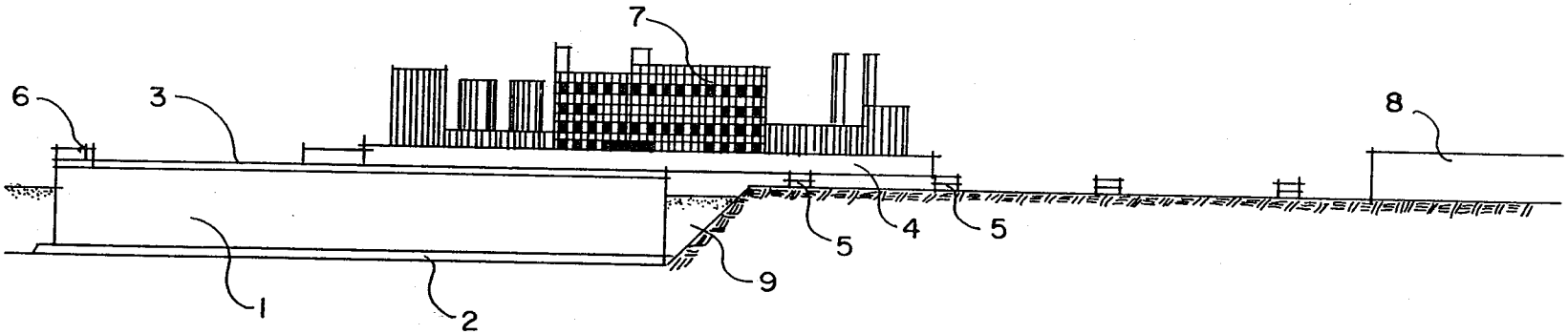

FIGS. 1 and 1*a* show the transport barge (1) laid up on a sand bed (2) with a mounted sliding and load-distributing system (3), for example in the form of girders, slabs, sheets and shell or framework constructions. The plant (7) which is mounted on the foundation (4) is launched mainly horizontally forward just to the shoreline (9) and runs over a provisional support system (sliding supports) (5) with the aid of a pulling or pushing device, for example in the form of a hydraulically driven arrangement (6). Manufactured on site (8) is a support system constituting (a) sliding supports during the launching work and (b) the definitive foundation system for the plant.

The foundation construction, i.e. support system, is manufactured on shore, for example behind the quayside, on a waterfront or the like, in any case in connection with and in the neighbourhood of open water located so that permanent or temporary assembly of the plant and of its foundation can take place (processing industry, industrial workshops, hospitals, hotels and the like).

The foundations must be designed for assumptions of loads occuring during manufacture, transport, launching, assembly and operation of the unit (foundation and plant).

The foundations can be built of various materials, but preferably of steel and/or concrete with non-tensioned reinforced and/or prestressed reinforcement.

The foundations could for example be made of some, possibly three, hollow box girders of steel and/or concrete, connected to a common concrete slab, or other type of construction suitable for the purpose, to which the plant is secured.

In the plant's final position, the space between the girders can be used correspondingly as basement premises in a conventional plant. The space in the box girders could also be used, for example for pipe laying and processing installations; they can serve as culverts. The foundations can for example be manufactured as follows:

The foundations are launched from a site factory (8) over provisional sliding supports (5) laid out approximately between 5 and 50 meters apart, preferably spaced at intervals of between about 10 and 30 meters. For casting and launching, use could be made if necessary of the well-known incrementally launching method, which is now most often applied in major bridge construction projects and which enables foundations to be produced at the rate of about 15 meters per week. The cast parts are launched successively over the above-mentioned sliding supports (5).

Naturally this method is not the only one that can be used and the foundations can be built in quite different, possibly entirely conventional, ways; if for example the plant requires special construction of foundations. In this case, too, the supporting system of the foundations is laid up on sliding supports. The supporting system of the foundation construction is designed so that it obtains a smooth underside, e.g. on longitudinal supporting girders or structural elements, with the same method of operation enabling the whole foundation to be launched from ashore onto a transport barge (FIG. 1*a*) and/or from a transport barge onto land after sea transport, and/or in the case of removal on land before a definitive foundation is laid, in each case with the help of sliding equipment, e.g. in the form of slabs.

Figure 2:
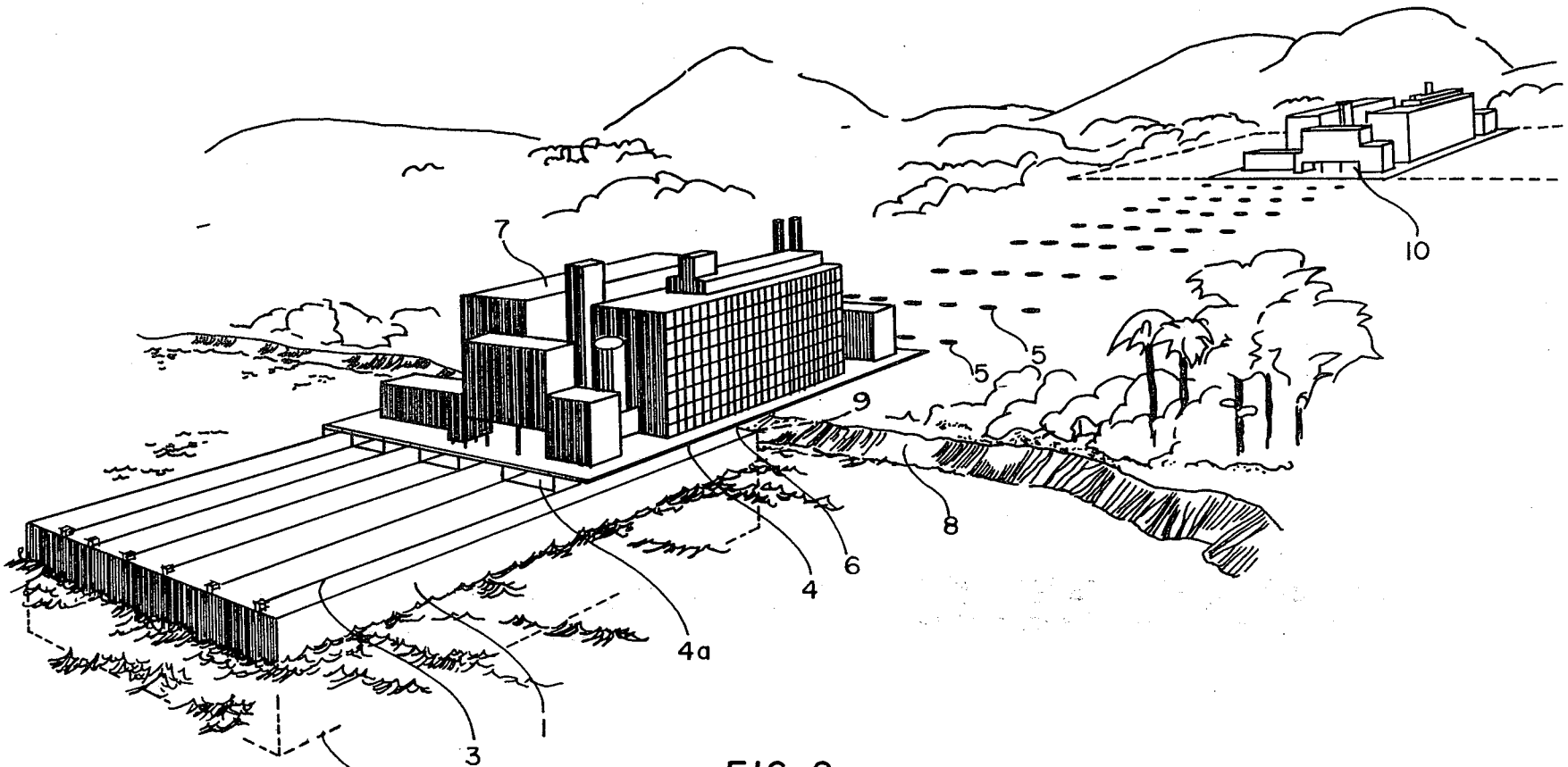
FIG. 2 is a perspective view showing the building structure mounted on the sliding foundation partially on the towing barge and partially ashore.

FIG. 2 shows the transport barge (1) set up on a macadam bed (2) and the plant (7) on its foundation (4) during setting ashore over the provisional sliding support system (5) on the way towards the permanent erection site (10). The cross-section of the foundation (4*a*) could be given a corresponding form, as for superstructures of bridges.

The necessary abutment when either the foundation is launched onto the barge or moved from the barge can be obtained by taking steps in accordance with known techniques, e.g. in the form of different foundation constructions or anchorages. It is also possible to obtain the necessary abutment by friction between the barge bottom and fillings of e.g. macadam or sand and the like, in which case the friction can be increased by vertical loading of the transport barge, e.g. by filling with water or with other ballast.

The sliding supports are designed for the existing instances of loading, supplemented by a structural unit preferably in the form of a concrete or steel girder whose upper surface is provided with a sliding surface having low friction. The sliding surface is rounded off in the launching direction in order to facilitate inward running of the sliding slabs.

Sliding equipment in the form of sheets, slabs, rollers or the like is pushed in between the sliding supports and the smooth underside of the foundation's supporting system, after which the launching proceeds. The sliding slabs can be built up of e.g. neoprene rubber with steel inserts on one side coated with a layer of teflon. The teflon layer of the sliding slabs is turned towards the stainless steel surface of the sliding plates.

In principle, this construction of sliding supports, sliding slabs and the hydraulic launching method is known in quite a different context, namely bridge building according to the so-called incrementally launching method.

Other methods of launching the plant with its appertaining foundations are of course also possible. For example, steel plates with a stainless steel or other smooth surface, with this surface downwards, can also be attached to the underside of the foundation's longitudinal supporting girders. The sliding slabs can also be laid out and fastened if required on the transport barge, then on the provisional or permanent supports on or adjacent to the land.

Combinations of these two methods can also be used if the procedure described in the invention is used, together of course with other methods and aids in order to enable large loads to be moved horizontally, e.g. with the aid of compressed air or fluids under pressure, by the use of so-called air cushions or fluid cushions.

The description of these arrangements or partial methods as stated in the invention does not restrict the usability of the invention or the scope of the patent applications.

If the plant including its foundation is launched from shore to barge or put ashore from the barge at the place of destination, the transport barge is lowered at the shore line on a prepared site. The bed can consist of levelled macadam or be of other construction necessary to give the pontoon a fairly subsidence-free support during removal or launching. To avoid subsidence of the pontoon, the bottom can be loaded beforehand by e.g. filling the transport pontoon with water.

The level of the slide rail on the transport barge must be correctly levelled with the sliding supports ashore. A subsequent adjustment of the height is possible by insertion of spacer equipment, preferably of steel, concrete or the like, by varying the thickness of the sliding slabs or by adjustment of the height and length of the sliding supports.

The transport barge can be lowered and raised and if necessary inclined by water adjustment.

Certain arrangements for use of the procedure are to some extent already known, though in quite different connections and when quite other methods of procedure are used. This is evident, for example, from an article in *Cement and Betong* 1972:1: "One step at a time—a new way to build a concrete bridge", and an article in the brochure *VÅra Vagar och Byggen* in 1978, pages 30–31. All arrangements and methods reported in this particular connection could be used when the method of procedure described in the invention is used.

One of the great advantages of the invention is the greater freedom of choice it gives when a decision is to be made on the position of the plant on or adjoining dry land. In a simple way and using simple means, the area around the plant and the positioning of the plant can be planned at a more or less long distance from the beach, if terrain conditions permit. When a method of procedure as described in the invention is used, upward gradients in the terrain of a maximum of 4% can be taken care of without special expensive arrangements —only a larger number of sliding supports and bigger launching power is needed; even steeper gradients and minor vertical removals are possible.

At the place of destination, the plant is adjusted after transport for inclination, if necessary, in relation to the horizontal position with the aid of hydraulic jacks which are placed at the foundation slabs of the sliding supports (definitive foundation). The plant can also be adjusted vertically if necessary with the aid of lifting equipment, using known techniques.

If use is made of the method according to known techniques with barges, concrete or steel may be exposed to aggressive subsoil water and sea water. If the inner parts of the barge are to be used for the plant, constant checking and perhaps pumping out will be required. If the foundation is built as described in the invention, the foundations in their definitive position will not come into contact with sea water: they will lie several meters above the water level even if located in the vicinity of the shoreline or on plinths in the water.

Definitive placing of the foundation for the plant takes place when it is erected on its permanent site (10) on loading distributing slabs or other forms of foundation in accordance with a known technique, after which the processing installation, the plant and the equipment are connected together before any adjustment and before the plant starts operation.

A side launching of the plant or its parts can take place if this is required in principle, in the same way as in accordance with the launching procedure as described in the invention. Different parts of the plant and/or parts of the foundation can be joined after launching is done, by e.g. intermediate casting between foundation slabs and the supporting system of the foundations.

The parts of the plant can also be connected to each other with respect to the function and construction of the plant.

The advantages of the method of procedure as stated in the invention and the use of the arrangements described in the invention as compared with known techniques are great and many.

Among these, the following may be mentioned:

Consumption of materials when foundations are manufactured as stated in the invention as compared with the quantity of materials required for production of conventional barges is considerably lower, sometimes less than one-half (if the concrete alternative is used).

Use of the foundation method for plants as stated in the invention reduces transport weights, shortens building times, without blockages of dock installations, and also shortens transport times, enabling effective use to be made of the special knowledge of designers, manufacturers and users.

Moreover, the prefabricated foundation for the plant need not be dimensioned for water loads of varying kinds during transport and use. It is also unnecessary for a floating transport device, e.g. in the form of a barge or boat, to be permanently incorporated in the plant when it is in use.

Further advantages obtained are:

possibility of placing the foundation without contact with sea water or subsoil water, i.e. radical reduction of underwater work when foundations are built, a provisional lowering bed instead of several permanent foundation beds, a considerable reduction of necessary earth-removing work under or in the vicinity of water level, and substantially simplified connecting-up, and possibility of prefabrication of supply service installation for e.g. electric current and water, etc.; this too giving great savings in time, resources and costs.

I claim:

1. A method of erecting, transporting and installing a building structure comprising the steps of:

(a) erecting a building structure on a foundation member of the type having smooth undersurfaces for moving the foundation member with the building structure thereon in sliding contact with the sliding surfaces on a floating barge, (b) sliding the foundation with the building structure thereon on said sliding surfaces on said floating barge from longitudinal sliding means on land until the foundation is carried fully on said floating barge, then, (c) transporting said barge to a site, and (d) unloading said foundation by sliding the smooth surfaces of the foundation off said sliding surfaces of said floating barge to longitudinal sliding means at the site.

2. A method of erecting, transporting and installing a building structure comprising the steps of erecting a building structure on a foundation member of the type having smooth undersurfaces for moving the foundation member with the building structure thereon in sliding contact with sliding surfaces on a floating barge, said erecting of the building structure taking place while the foundation is carried on said barge, transporting said barge with the building structure and foundation thereon to a site, and unloading said foundation and building structure by sliding the smooth surfaces of the foundation off said sliding surfaces of said floating barge to longitudinal sliding means at the site.

* * * * *